US006062813A

United States Patent [19]

Halliwell et al.

[11] Patent Number: 6,062,813

[45] Date of Patent: May 16, 2000

[54] BLADED ROTOR AND SURROUND ASSEMBLY

[75] Inventors: Mark A Halliwell; Steven B Morris, both of Derby, United Kingdom; Harald Schiebold, Berlin, Germany

[73] Assignee: Rolls-Royce plc, London, United Kingdom

[21] Appl. No.: 08/967,979

[22] Filed: Nov. 12, 1997

[51] Int. Cl.[7] ..... F01D 11/02

[52] U.S. Cl. ..... 415/174.5; 415/173.1; 415/173.4; 415/173.5; 415/173.6; 415/189; 415/190

[58] Field of Search ..... 415/171.1, 173.1, 415/173.4, 173.5, 173.6, 189, 190, 209.2, 209.3

[56] References Cited

U.S. PATENT DOCUMENTS

| | | | |
|---|---|---|---|
| 3,067,983 | 12/1962 | Koziura | 415/209.2 |
| 3,823,553 | 7/1974 | Smith | 60/39.16 R |
| 4,796,423 | 1/1989 | Lievestro et al. | 60/39.33 |
| 5,064,343 | 11/1991 | Mills | 415/173.3 |
| 5,201,846 | 4/1993 | Sweeney | 415/173.6 |
| 5,232,340 | 8/1993 | Morgan . | |
| 5,407,320 | 4/1995 | Hutchinson | 415/116 |

FOREIGN PATENT DOCUMENTS

| | | |
|---|---|---|
| 134186 | 3/1985 | European Pat. Off. . |
| 356305 | 2/1990 | European Pat. Off. . |
| 545589 | 6/1993 | European Pat. Off. . |
| 618349 | 10/1994 | European Pat. Off. . |
| 974589 | 2/1961 | Germany . |
| 3333436 | 2/1985 | Germany . |
| WO 17686 | 10/1992 | WIPO . |
| WO 20334 | 10/1993 | WIPO . |

*Primary Examiner*—Edward K. Look
*Assistant Examiner*—Ninh Nguyen
*Attorney, Agent, or Firm*—W. Warren Taltavull; Farkas & Manelli PLLC

[57] ABSTRACT

A bladed rotor and surround assembly comprising an annular casing, a bladed rotor element that is rotatable about an axis concentrically within the casing, and an annular shroud liner. The shroud liner, typically made up of an annular array of circumferentially abutting shroud liner segments, is disposed within the casing in an annular radial space defined between the casing and an outer circumference of the bladed rotor. The shroud liner segments have location members to locate each segment within the casing. The location members and the annular radial space are configured to enable axial insertion of the shroud liner segment between the bladed rotor and the casing. In addition the location members and the annular radial space allow a limited amount of radial translation of the shroud segment during insertion. The location members also provide a positive radial location to prevent radial translation of the shroud segment once each shroud segment is in a final assembled position.

19 Claims, 3 Drawing Sheets

BLADED ROTOR AND SURROUND ASSEMBLY

FIELD OF THE INVENTION

The present invention relates to a bladed rotor surround assembly especially such assemblies found within a gas turbine engine. In particular the invention concerns the shroud liner segments of such a turbine stage of a gas turbine engine and a method of assembly and locating them within that turbine stage.

BACKGROUND OF THE INVENTION

In gas turbines it is desirable to reduce gas leakage around the turbine blades in order to improve the efficiency of the turbine. This can be achieved by surrounding each array of turbine blades with a ring of abradable honeycomb material. As the turbine rotates the tips of the turbine blades cut a path through the abradable material, so ensuring that only a very small gap is left between the turbine blade tips and the surface of the abradable material. Since this gap is very small, leakage is restricted.

Unfortunately the abradable material tends to erode slowly in the extreme environment found within the turbine. As a result the abradable material must be replaced regularly. In order to make replacement simple the abradable material is supported by metal shroud liners. These shroud liners are in turn attached to the structural casing of the turbine. Furthermore the shroud liners are circumferentially segmented to make assembly simpler, allow individual areas of the lining to be replaced, and to accommodate better any distortions caused by the extreme temperatures within the turbine.

It is necessary to attach the shroud segments to the structural casing so that they are held accurately relative to the blade tips. This is important since any movement is likely to increase the clearance at the blade tips, so increasing leakage. The mounting is either directly from the casing, from the stationary nozzle guide vane assemblies which precede and follow the turbine rotor and are themselves fixed to the casing, or from a combination of both. A conventional arrangement is to have accurately machined circumferential slots or grooves into which mating lugs locate. This provides accurate fixed location of the segments.

Shrouded turbine blades can be employed to further reduce leakage around the blades. By using a shrouded blade a seal can be produced between the blade shroud and the abradable surface of the shroud segment. The seal further reduces leakage past the blade tip. Typically a fin seal arrangement is used. A step can be provided between successive fins to improve the seal effectiveness. A corresponding step is also provided on the profile of the abradable honeycomb material on the segmented shroud liner. The profiling and the cooperation with the stepped fins upon shrouded blades makes accurate assembly complex. Such arrangements generally require that the shroud segments of the shroud liner are fitted, at least partially, into the casing before, and without, the turbine rotor assembly with which they are associated being fitted. If the segments are fitted with the turbine rotor already installed then an excessive clearance between the shroud segment and blade shroud would be required to allow for assembly. This is particularly the case when the rear fins of the fin seal are of a larger radius than the forward fins. This excessive clearance would produce an increased leakage over the turbine blade tips and therefore a consequent performance loss.

Other considerations may require that the turbine rotor has to be fitted into the casing before the shroud segments are fitted. This can be the case if, for example, the turbine rotor of one stage of the gas turbine engine has to be assembled and balanced with another associated component of the engine. To ensure the components remain in balance the resultant rotating assembly has to be fitted as single unit. In these cases a stepped shroud liner and shrouded blades are generally not used, and thus the performance improvement is not realised.

SUMMARY OF THE INVENTION

The present invention seeks to provide a method of mounting shroud liners which allows them to be fitted and removed without requiring the removal of the associated bladed rotor assembly.

According to the present invention a bladed rotor and surround assembly comprises an annular casing, a bladed rotor element that is rotatable about an axis concentrically within the casing, and an annular shroud liner disposed within the casing in an annular radial space defined between the casing and an outer circumference of the bladed rotor, the shroud liner is made up of an annular array of circumferentially abutting shroud liner segments each of which has a first positive radial location means and a second location means to locate each segment within the casing characterised in that the annular radial space and first location means are configured to enable axial insertion of the shroud segment between the bladed rotor and the casing, and that the second location means and the annular radial space are configured to allow a limited amount of radial translation of the shroud segment during axial insertion of the shroud segment, the second location means providing positive radial location to prevent radial translation of the shroud segment only when each shroud segment is in a final assembled position.

Preferably the assembly is part of an axial compressor assembly, or part of an axial turbine assembly preferably of a gas turbine engine.

Furthermore the shroud liner when in an assembled position may surround the outer circumference of the bladed rotor and provides a sealing means.

Preferably the shroud liner has in an axial direction a radially stepped internal profile which cooperates with a similarly profiled outer circumference of the bladed rotor producing a stepped sealing means between the bladed rotor and shroud liner.

Preferably in an axial direction the radius of the outer circumference of the bladed rotor is not constant. Additionally the radius of the outer circumference of the bladed rotor may generally decreases in an axial direction with the shroud segment adapted to be inserted in substantially that axial direction.

Preferably the assembly is adapted such that the shroud segment can be inserted between the bladed rotor and the casing by consecutive axial and radial translation of the shroud segment.

The bladed rotor may be provided with an annulus of material that is substantially concentric with the casing.

Furthermore the outer circumference of the bladed rotor may have at least one circumferential radial fin protrusion substantially perpendicular to the assembly axis and extending in a radially outward direction.

Preferably the second location means may comprise a hook member, the hook member engaging a casing slot in an internal surface of the casing as the shroud segment is axially inserted. The hook member may further comprise an integral part of the shroud liner assembly.

Furthermore the casing slot within the internal surface of the casing may be radially deeper than the hook means engaging within it allowing the hook means to be radially translated within the casing slot during axial insertion of the shroud segment, further means securing the hook means within the casing slot once the shroud segment has been inserted may also be provided. The hook means is secured within the casing slot by a part of a stator vane assembly.

Also according to the present invention is a method of installing a shroud liner within an annular casing, the shroud liner once installed surrounding and providing a sealing means around an outer circumference of a bladed rotor which rotates about an axis, the shroud liner comprising an annular array of circumferentially abutting shroud liner segments which are individually fitted into the casing to define the complete shroud liner, the method of fitting the individual segments comprising the following successive steps:

a) installing the bladed rotor within the casing, b) axially inserting a shroud liner segment between the outer circumference of the bladed rotor and the casing, c) radially translating the shroud liner segment, d) repeating steps b) and c) until a location means of the shroud segment locates the shroud segment within the casing.

Preferably following step a) above the bladed rotor is translated axially rearward. Once all the shroud line segments have been installed the bladed rotor is translated axially forward.

BRIEF DESCRIPTION OF THE DRAWINGS

The present invention will now be described by way of example with reference to the accompanying drawings in which.

DETAILED DESCRIPTION OF THE INVENTION

Figure 1:
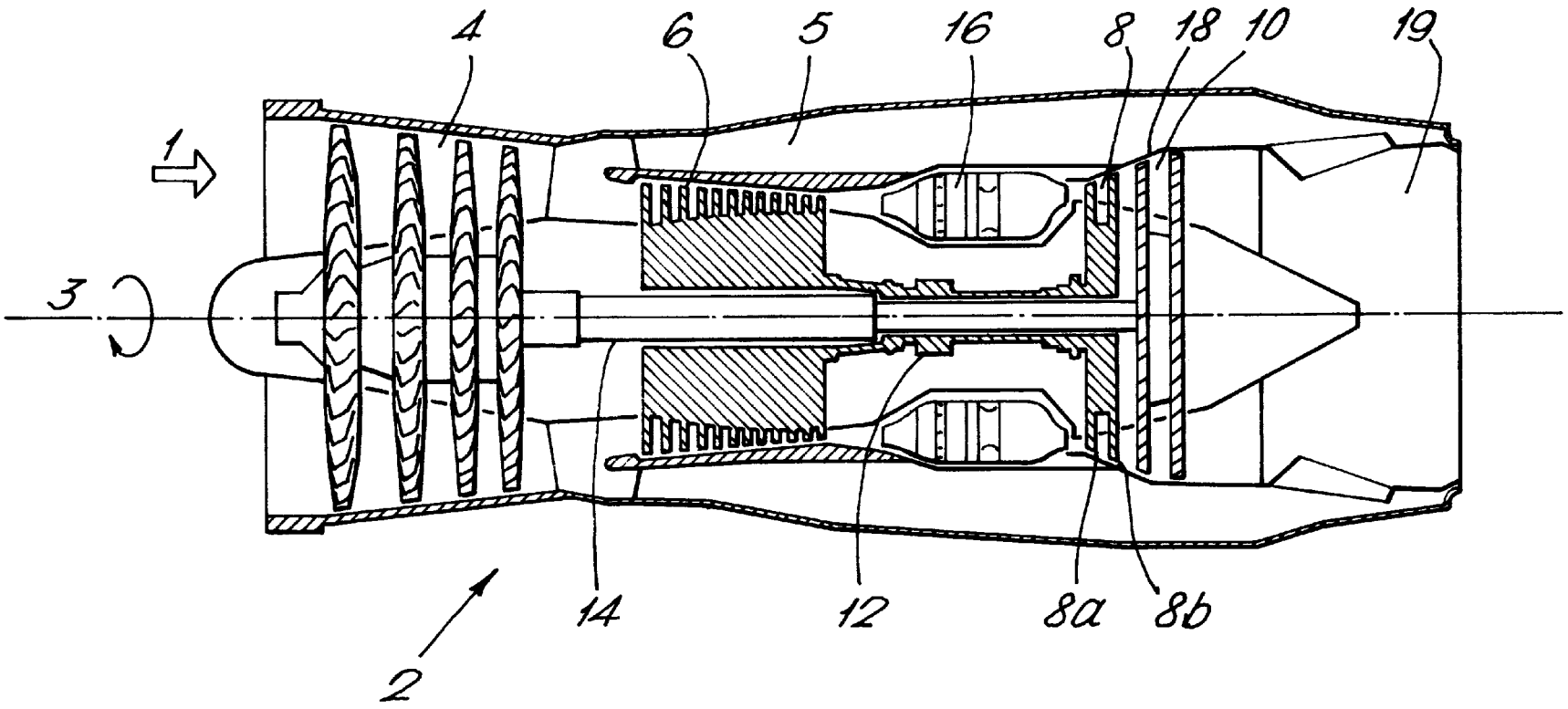
FIG. 1 shows a simplified section of a typical gas turbine engine.

Referring to FIG. 1 there is illustrated a gas turbine engine 2. This engine 2 basically comprises low and high pressure compressors 4,6, a combustor 16, and high and low pressure turbines 8,10. The compressors 4,6 and turbines 8,10 are of a rotary design and rotate about a single engine axis 3. In operation an air flow 1 is compressed by the compressor 4. A portion of this compressed air flow flows through a bypass duct 5 and bypasses the other sections of the engine 2. The remainder of the compressed air is further compressed in compressor 6 and then mixed with fuel and burnt in the combustor 16. The resultant hot gas flow produced in the combustor 16 then flows into the turbine sections 8,10. The turbine sections 8,10 extract energy from the gas flow to provide a driving torque for the compressors 4,6. This driving torque is transmitted via shafts 12,14 which connect their respective compressors 6,4 and turbine sections 8,10. The flow exiting the turbine section 10 is finally mixed with a bypass flow 5 before exiting the engine 2 through an exhaust nozzle 19.

The high pressure turbine section 8 has two turbine rotor elements 8*a* and 8*b* which are connected together and rotate about the engine axis 3 within an annular turbine casing 18. Each turbine rotor element 8*a*,8*b* comprises an annular array of aerofoil shaped turbine blades 7*a*,7*b* affixed to a turbine disc 6*a*,6*b* forming a bladed rotor. The two turbine discs 6*a* and 6*b* are connected together to link the turbine rotor elements 8*a* and 8*b* together forming the single turbine rotor assembly 9. This turbine rotor assembly 9 is assembled, matched, and balanced as a single unit which is then fitted as such into the casing 18.

Figure 2:
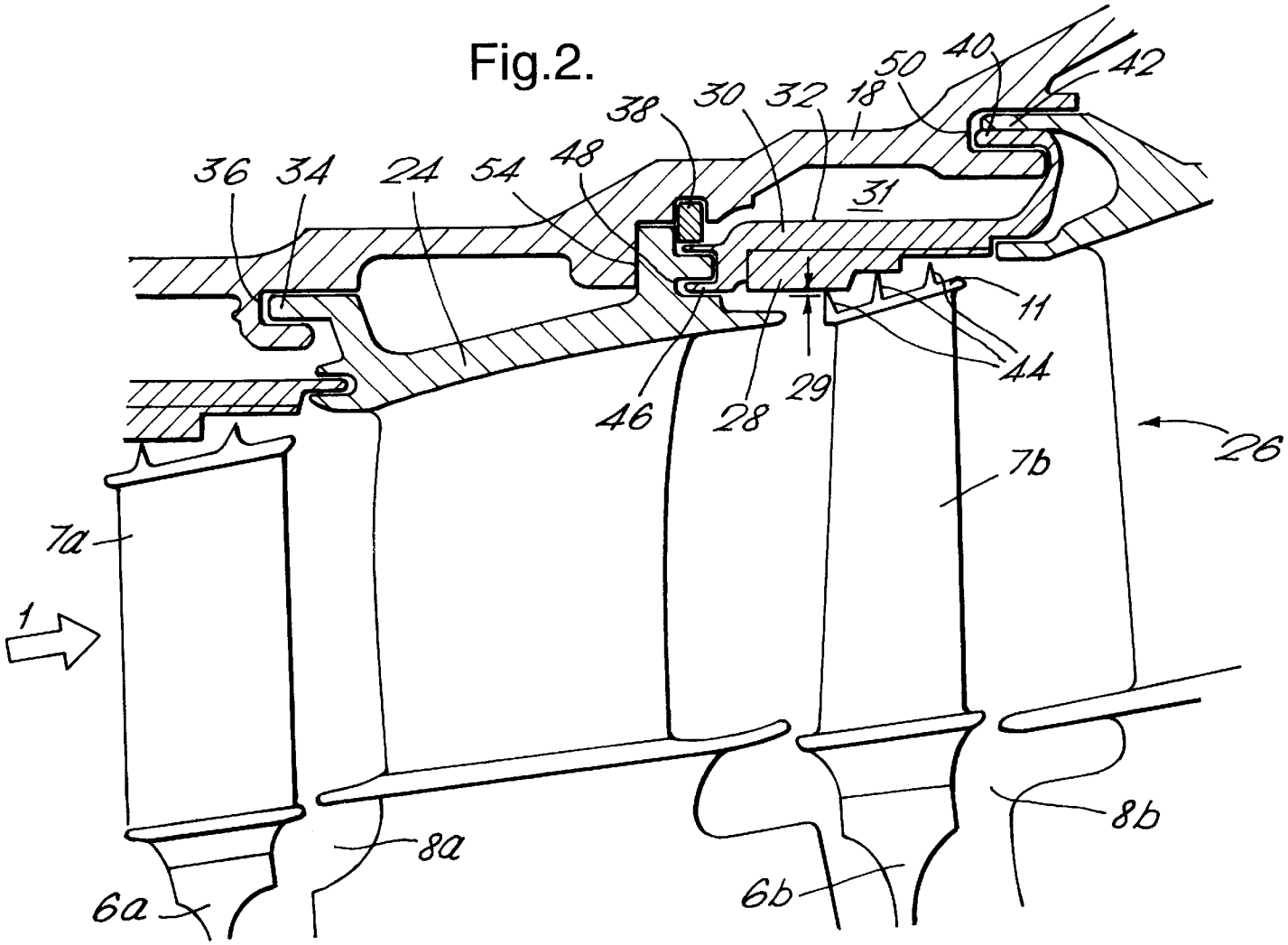
FIG. 2 shows a cross section through the turbine section of a gas turbine engine incorporating the invention.

A more detailed view of the outer section of the high pressure turbine 8 can be seen if reference is now made to FIG. 2. Interposed between the two turbine rotor elements 8*a* and 8*b*, is a front stator vane assembly 23 comprising a plurality of stator vanes 24 arranged in an annular array. The stator vanes 24 are located and retained by conventional means comprising a front lip 34 which locates within a birdmouth slot 36 formed in the casing 18. At the rear radial locating dowels (not shown), a piston ring 38 and casing groove 54 provide the necessary axial, circumferential and radial location of the stator vanes 24.

The stator vane assembly 23 is disposed between the two turbine rotor elements 8*a*,8*b*. These rotor elements 8*a*,8*b* are fitted in to the casing 18 as a single turbine rotor assembly 9. Therefore in order to fit the stator vane assembly 23 in between the rotor elements 8*a*,8*b* the stator vane assembly 23 is fitted into the casing 18 at the same time as the turbine rotor assembly 9. This is accomplished by building up the annular array of stator vanes 24, which makes up the stator vane assembly 23, around the turbine rotor assembly 9. The combined stator vane and turbine rotor assembly 23,9 is then inserted into the casing 18 with the individual stator vanes 24 of the stator vane assembly 23 engaging within their respective casing location means 36, 54.

Downstream of the turbine rotor element 8*b* is a rear stator vane assembly 25 comprising a second plurality of stator vanes 26 arranged in an annular array. These stator vanes 26 are attached to the casing 18 in a similar fashion to the stator vanes 24 of the front stator vane assembly 23. The rear stator vane assembly 25 is fitted into the casing 18 subsequent to fitting the turbine rotor assembly 9, front stator vane assembly 23 and the shroud liner segments 32.

A blade shroud element 11 is provided on the radially outer tip of each rotor blade 7*b*. The blade shrouds 11 of each rotor blade 7*b* abut each other to provide a complete ring of material around the outside of the turbine rotor element 8*b*. This ring of material is substantially concentric with the casing 18.

On the radially outer side of the blade shroud 11 of each blade 7*b* are three axially spaced fin ribs 44. These fin ribs 44 are aligned in a circumferential direction, substantially perpendicular to the engine axis 3, and extend radially outwards towards the casing 18. The fin ribs 44 of each blade 7*b* abut the fin ribs 44 of adjacent blades to provide three complete circumferential ribs around the circumference of the assembled bladed rotor 8*b*. The three fin ribs 44 are radially stepped in an axial direction so that the fin tips of each of the three fin ribs 44 are at different radii. In this embodiment the fin tip of the rearmost fin rib 44 has a greater radial extent than that of those towards the front.

Radially outwardly of the rotor 8*b* are a plurality of circumferentially abutting shroud liner segments 32. These cooperate to form a complete shroud liner ring on the inner surface of the casing 18 and around the rotor blades 7*b*. Each segment 32 has an abradable layer 28 of, for example, a filled honeycomb material extending along part of its length adjacent the rotor blades 7*b*. Therefore when the segments 32 are assembled into the shroud liner ring a complete layer 28 of abradable material surrounds the rotor blades 7*b*. The abradable layer 28 has, in the flow direction 1, a radially stepped internal profile. This profile is in close proximity to, and cooperates with, the stepped fin ribs 44 of the shroud element 11 on each blade 7*b* to produce a stepped seal. Within this seal the tips of the fins 44 cut their own clearance path within the abradable layer 28. A close clearance 29 is thereby produced at the blade tips between the rotor fins 44 and the shroud segment 32. This combined with the stepping of the seal arrangement produces an effective seal which reduces gas leakage over the tips of the turbine blades 7*b*.

In the rear of the radially outer portion of each of the stator vanes 24 of the front stator vane assembly 23 an axially extending birdmouth slot 48 is provided. Within these birdmouth slots 48 the upstream ends of the shroud segments 32 are positively located via suitably shaped mating tangs 46 of each segment 32. A hook element 40 is provided on the downstream end of each shroud segment 32. This hook 40 locates within a wide mouthed birdmouth slot 50 in the internal surface of the casing 18. Also locating into this wide mouthed birdmouth slot 50 are the front locating tangs 42 of each of the stator vanes 26 from the rear stator vane assembly 25. These tangs 42 fill the remaining space within the wide mouthed birdmouth slots 50 and fix the shroud segment hooks 40 in position within the birdmouth slots 50. By this arrangement each of the shroud segments 32, which cooperate to form the complete shroud liner ring, is radially located and mounted within the casing 18 in its assembled position. Additional location can be provided by a number of location dowels (not shown) which are fitted through the rear hook elements 40 into the casing 18, preventing circumferential movement.

Figure 3A:
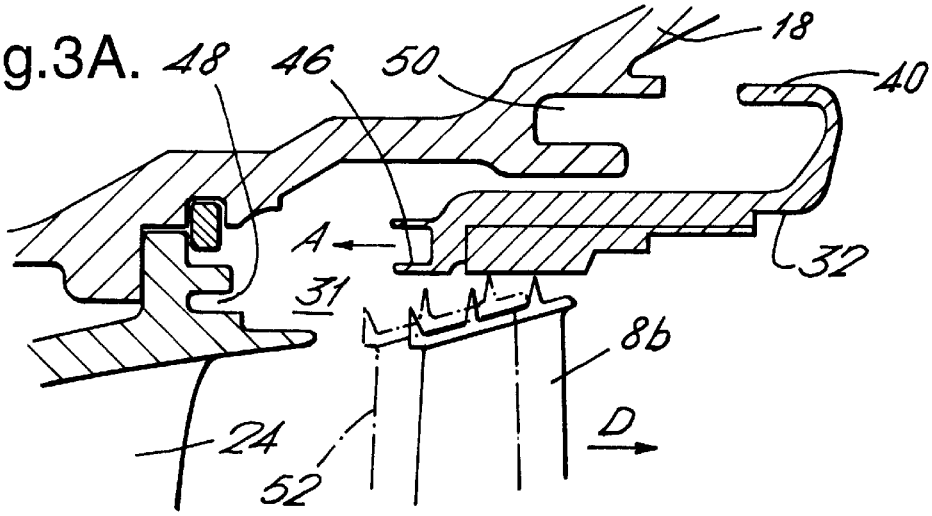
FIGS. 3*a* to 3*c* illustrate the assembly of the shroud segments according to the invention.

This mounting arrangement, and careful sizing of the shroud liner, allows the turbine section 8 as a whole to be assembled in the following manner. The stator vanes 24 of the front stator vane assembly 23 and the turbine rotor assembly 9, comprising the two turbine elements 8*a*,8*b*, are fitted into the casing 18. With the turbine rotor assembly 9 still within the casing 18 the assembly 9 is translated axially rearwards within the axial build clearances that exist between the static and rotating components. This axial translation is shown in FIG. 3*a* by arrow D. The phantom line 52 illustrates the normal location of the turbine element 8*b* shown in FIG. 2.

Figure 3B:
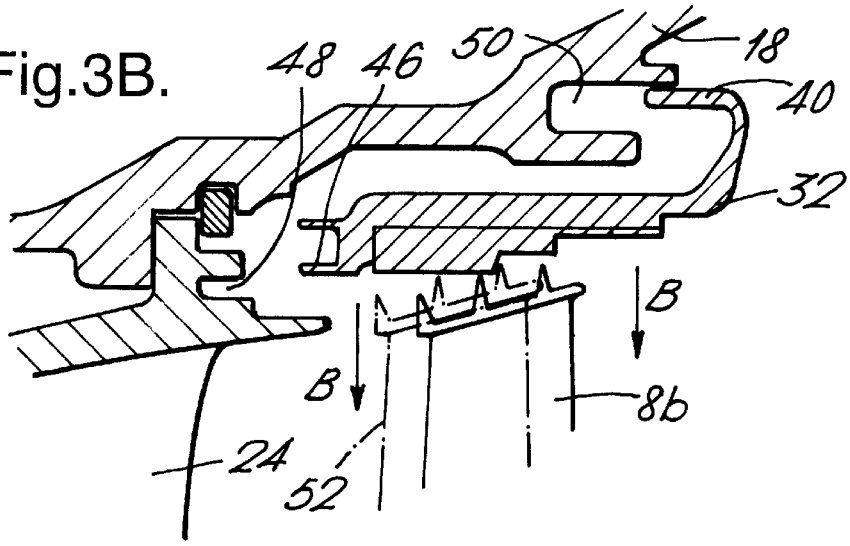
Figure 3C:
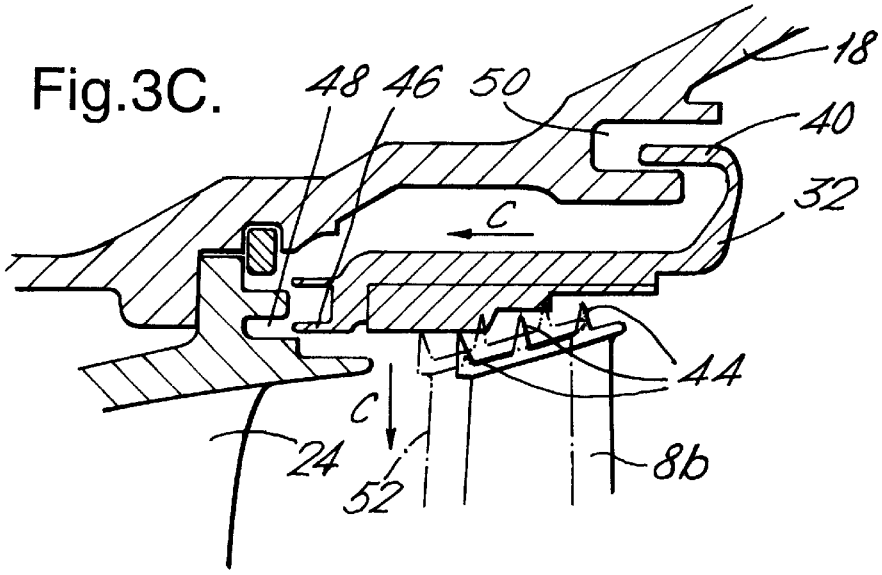

The individual shroud segments 32 are then axially inserted between the blade shroud fin tips 44 and the casing 18. The insertion is from the rear in an axial direction substantially parallel to the engine axis 3. As the stepped profile of the segment 32 is inserted axially beyond, and over, each of the three blade fin ribs 44 the segment 32 can be translated radially inward, following the stepped profile of the abradable layer 28 of the segment 32. This sequence of axial and radial translation of the segment 32 is repeated until the segment 32 is installed. This is shown by arrows A,B, and C in FIGS. 3*a*,3*b* and 3*c* which illustrate the insertion of the shroud segments according to the invention.

By the above method each shroud segment 32 can be moved sufficiently far radially inward and axially forward for the front tang 46 of the segment 32 to be fitted into the birdmouth slot 48 of one of the stator vanes 24 of the front stator vane assembly 23. The rear hook 40 of the each segment 32 slots into birdmouth slot 50 as the segment 32 is inserted.

The subsequent radial translation of each of the shroud segments 32, described in the above method, reduces the large clearance between the shroud liner and the outer circumference of bladed rotor element 8*b* which is required to allow the axial insertion of the shroud segments 32. In addition it allows the front step of the shroud liner to be positioned inside the outer radius of the most rearward of the fin tips 44. This thereby produces an effective stepped seal arrangement which also improves the sealing efficiency.

The stator vanes 26 of the rear stator vane assembly 25 are then fitted, with the front tang 42 of each vane 26 also locating within the birdmouth slot 50. The hook 40 of each shroud segment 32 is thereby held in place and positively located within the casing. This in turn positively locates each shroud segment 32 within the casing.

Finally, once all of the shroud segments 32 have been installed the turbine rotor assembly 9 is translated axially forward to its normal operating position.

To allow for this stepping insertion of the segments 32, sufficient radial space 31 is provided in the annulus between the casing 18 and the blade fin tips 44. The locating of the hook 40 that mounts the rear of each segment 32 also has to allow the segment 32 to be moved radially as the segment 32 is inserted. As shown in this embodiment the birdmouth slot 50 is radially deeper than the radial depth of the portion of the hook 40 engaging within it. The hook element 40, and so the segment, can therefore be radially moved within the birdmouth 50. The final operating position of the hook 40 is fixed by the stator vanes 26 of the rear stator vane assembly 25 once they are installed.

It will be apparent to those skilled in the art that the hook 40 on the rear of each shroud segment 32 does not have to form an integral part of the shroud segment 32 itself. In other embodiments the hook 40 can be a separate reverse C section piece with the top of the C section fitting into birdmouth 50 and the lower portion supporting the shroud segment 32. Such a C section would be fitted after the shroud segment 32 had been inserted.

Further details of the specific embodiment described and shown in the drawings may also be altered without detracting from the invention. For example the shroud segments 32 could be mounted at the front directly from the casing 18 rather than from the stator vanes 24 of the front stator vane assembly 23. The rear hook of the shroud segment 32 may also be held within the birdmouth slot 50 by other means rather than by the stator vanes 26 of the rear stator vane assembly 25.

It will further be apparent that although the invention has been described with reference to a two stage high pressure turbine section 8 the invention may equally be applied to other turbine sections with different numbers of stages. Indeed it may also be applied to the compressor section of a gas turbine engine or to some other similar assembly not necessarily within a gas turbine engine. In addition the reasons for fitting the shroud segments into the casing after the bladed structure may be different. The invention does not require that two turbine rotors are connected.

It will also be appreciated that although the invention has been described with reference to axially installing the shroud liner segments from the rear, or downstream end, of the engine. In other arrangements of the invention the shroud liner segments could be installed from the front, or upstream end, of the engine. The stepped seal arrangement between the shroud liner and the bladed rotor could also be similarly stepped in the opposite axial direction to that described. The stepping could also be such that an intermediate fin is at the largest radius with fins axially either side being inside the radius of this intermediate fin.

The invention has been described with reference to a turbine with shrouded turbine blades. The invention although particularly suited for use in turbines with shrouded blades is not limited to such turbines and can be applied to turbines or compressors with unshrouded turbine blades.

We claim:

1. A bladed rotor and surround assembly comprising an annular casing, having an internal surface, a bladed rotor element which is rotatable about an axis concentrically within the casing, the bladed rotor having an outer circumference, and an annular shroud liner disposed within the casing, said annular shroud liner comprising an annular array of circumferentially abutting shroud liner segments, each of the shroud liner segments having a first positive radial location means and a second location means to locate each segment within the casing; the casing and the outer circumference of the bladed rotor defining an annular radial space and said first location means being configured to enable axial insertion of the shroud segment between the bladed rotor and the casing, said second location means and the annular radial space being configured to allow a limited amount of radial translation of the shroud segment during said axial insertion of the shroud segment, such that the shroud segment can be inserted between the casing and the bladed rotor by consecutive axial and radial translation of the shroud segment, the second location means providing positive radial location for the shroud segment to prevent radial translation of the shroud segment only when each shroud segment is in a final assembled position.

2. A bladed rotor and surround assembly as claimed in claim 1 in which the assembly is part of an axial compressor assembly.

3. A bladed assembly and surround assembly as claimed in claim 1 in which the assembly is part of an axial turbine assembly.

4. A bladed rotor and surround assembly as claimed in claim 1 in which the assembly is part of a gas turbine engine.

5. A bladed rotor and surround assembly as claimed in claim 1 in which the shroud liner when in an assembled position surrounds the outer circumference of the bladed rotor and provides a sealing means.

6. A bladed rotor and surround assembly as claimed in claim 1 in which the shroud liner has in an axial direction a radially stepped internal profile which co-operates with a similarly profiled outer circumference of the bladed rotor producing a stepped sealing means between the bladed rotor and shroud liner.

7. A bladed rotor and surround assembly as claimed in claim 1 in which in an axial direction the radius of the outer circumference of the bladed rotor is not constant.

8. A bladed rotor and surround assembly as claimed in claim 7 in which the radius of the outer circumference of the bladed rotor generally decreases in an axial direction with the shroud segment.

9. A bladed rotor and surround assembly as claimed in claim 1 in which the outer circumference of the bladed rotor is provided with an annulus of material that is substantially concentric with the casing.

10. A bladed rotor and surround assembly as claimed in claim 9 in which the outer circumference of the bladed rotor has at least one circumferential radial fin protrusion substantially perpendicular to the assembly axis and extending in a radially outward direction.

11. A bladed rotor and surround assembly as claimed in claim 1 in which the second location means comprises a hook member, and an internal surface of the casing there is provided a casing slot; the hook member engaging the casing slot as the shroud segment is axially inserted.

12. A bladed rotor and surround assembly comprising an annular casing, having an internal surface, a bladed rotor element which is rotatable about an axis concentrically within the casing, the bladed rotor having an outer circumference, and an annular shroud liner disposed within the casing, said annular shroud liner made up of an annular array of circumferentially abutting shroud liner segments, each of the shroud liner segments having a first positive radial location means and a second location means to locate each segment within the casing; the casing and the outer circumference of the bladed rotor defining an annular radial circumference of the bladed rotor defining an annular radial space, said annular radial space and said first location means being configured to enable axial insertion of the shroud segment between the bladed rotor and the casing, said second location means and the annular redial space being configured to allow a limited amount of radial translation of the shroud segment during said axial insertion of the shroud segment, the second location means providing positive radial location for the shroud segment to prevent radial translation of the shroud segment only when each shroud segment is in a final assembled position, said second location means comprising a hook member and an internal surface of the casing having a casing slot, the hook member engaging the casing slot as the shroud segment is axially inserted.

13. A bladed rotor and surround assembly as claimed in claim 12 in which the hook member comprises an integral part of the shroud liner assembly.

14. A bladed rotor and surround assembly as claimed in claim 12 or 13 in which the casing slot within the internal surface of the casing is radially deeper than the hook means engaging within it allowing the hook means to be radially translated within the casing slot during axial insertion of the shroud segment, and further means securing the hook means within the casing slot once the shroud segment has been inserted.

15. A bladed rotor and surround assembly as claimed in claim 12 or 13 in which the hook means is secured within the casing slot by a part of a stator vane assembly.

16. A method of installing a shroud liner within an annular casing, the shroud liner once installed surrounding a bladed rotor which is rotatable about an axis concentrically within the casing, the bladed rotor having an outer circumference, the shroud liner providing a sealing means around an outer circumference of a bladed rotor, the shroud liner comprising an annular array of circumferentially abutting shroud liner segments which are individually fitted into the casing to define the complete shroud liner, the method of fitting the individual segments comprising the following successive steps:

a) installing the bladed rotor within the casing, b) axially inserting a shroud liner segment between the outer circumference of the bladed rotor and the casing, c) radially translating the shroud liner segment, d) repeating steps b) and c) until a location means of the shroud segment locates the shroud segment within the casing.

17. A method of installing a shroud liner as claimed in claim 16 in which following step a) the bladed rotor is translated axially rearward, and in which once all the shroud liner segments have been installed the bladed rotor is translated axially forward.

18. A bladed rotor and surround assembly as claimed in claim 14 in which the hook means is secured with the casing slot by a part of a stator vane assembly.

19. A bladed rotor and surround assembly comprising an annular casing, having an internal surface, a bladed rotor element which is rotatable about an axis concentrically within the casing, the bladed rotor having an outer circumference, and an annular shroud liner disposed within the casing, said annular shroud liner made up of an annular array of circumferentially abutting shroud liner segments, each of the shroud liner segments having a first positive radial location means and a second location means to locate each segment within the casing; the casing and the outer circumference of the bladed rotor defining an annular radial circumference of the bladed rotor defining an annular radial space, said annular radial space and said first location means being configured to enable axial insertion of the shroud segment between the bladed rotor and the casing, said second location means and the annular redial space being configured to allow a limited amount of radial translation of the shroud segment during said axial insertion of the shroud segment, the second location means providing positive radial location for the shroud segment to prevent radial translation of the shroud segment only when each shroud segment is in a final assembled position, said second location means comprising a hook member and an internal surface of the casing having a casing slot, the hook member engaging the casing slot as the shroud segment is axially inserted, said bladed rotor having an outer circumference with a radius that decreases in an axial direction with said shroud segment, the assembly being arranged such that the shroud segment is insertable between the bladed rotor and the casing by consecutive axial and radial translations of the shroud segment.

* * * * *